United States Patent [19]

Jumel

[11] Patent Number: 4,555,967

[45] Date of Patent: Dec. 3, 1985

[54] MACHINE FOR CUTTING PIECES FROM A BAND MATERIAL

[75] Inventor: Jean-Pierre Jumel, Le Vesinet, France

[73] Assignee: Societe Nationale Industrielle et Aerospatiale, Paris, France

[21] Appl. No.: 523,793

[22] Filed: Aug. 16, 1983

[30] Foreign Application Priority Data

Aug. 17, 1982 [FR] France ..... 82 14211

[51] Int. Cl.[4] ..... B26D 5/40

[52] U.S. Cl. ..... 83/106; 83/208; 83/369; 83/732; 83/649; 83/559; 83/216

[58] Field of Search ..... 83/208, 106, 581, 471.3, 83/369, 559, 649, 216, 650, 732, 614; 242/56 R, 56 B, 67.2, 55, 65, 67.3 R

[56] References Cited

U.S. PATENT DOCUMENTS

| | | | |
|---|---|---|---|
| 3,207,019 | 9/1965 | Vanzo | 83/508 |
| 3,762,259 | 10/1973 | Kuts | 83/471.3 |
| 3,861,259 | 1/1975 | Hitch | 83/106 |
| 3,989,201 | 11/1976 | Cottrell | 242/55 |
| 4,026,172 | 5/1977 | Off et al. | 83/369 |
| 4,151,772 | 5/1979 | Johnson | 83/418 |
| 4,375,175 | 3/1983 | Elsas | 83/208 |
| 4,440,055 | 4/1984 | Gelfand | 83/581 |

*Primary Examiner*—James M. Meister
*Assistant Examiner*—John L. Knoble
*Attorney, Agent, or Firm*—Fisher, Christen & Sabol

[57] ABSTRACT

Machine intended for cutting out transversely, along a straight or broken, oblique or right-angled cutting line, a band material adapted to be fed parallel to its length.

This machine has in combination, a device to unwind the band at constant linear speed from a reel and a second device to, firstly, advance the unwound band at constant linear speed from a fixed plane support which extends at least from the second device into proximity of the cutting system, and secondly, permit an edge of the band to be applied against a lateral edge guide. Use of this machine includes cutting of pieces from flexible compound material.

10 Claims, 10 Drawing Figures

MACHINE FOR CUTTING PIECES FROM A BAND MATERIAL

BACKGROUND OF THE INVENTION

The invention relates to a machine intended for cutting transversely, along a straight or broken line, a band material adapted to be fed parallel to its length.

Machines of this type are already known, particularly from U.S. Pat. Nos. 3,207,019 and 3,762,259 and French Pat. No. 1,421,910, comprising on the one hand a plane horizontal surface upon which the band material to be cut transversely can be fed, and on the other hand, a train transverse to said band material, mounted rotatably about a vertical axis centered relative thereto and carrying a cutting system executing a reciprocating movement.

In all these known devices, the feed of the band is effected by an endless conveyor upon which it rests. As a result, these devices can equally well treat sheet materials and continuous band materials. However, due to the relative slip which inevitably occurs between the band and the endless conveyor upon which it rests, and by virtue of which it is fed, these known devices are not adapted for cutting out highly accurate pieces from a band coming directly from a reel, so that it is difficult for them to be completely automated and, for example, integrated in an automated production process of the CAD-type (computer-assisted design).

The aim of the invention is to overcome this disadvantage, and it relates to a fully automated cutting machine, the automation of which can be effected by a numerical control system, and which can be integrated into an automated production process, said machine treating directly a band unwound from a reel.

SUMMARY OF THE INVENTION

The present invention is a machine intended for cutting transversely, along a straight or broken, oblique or right-angled cutting line, a band material adapted to be fed parallel to its length and resting on an at least substantially plane support surface, said machine comprising a train mounted for rotation about an axis at right angles to said support surface and carrying a cutting system executing a reciprocating movement transversely to said band along a cutting edge, is characterized in that it comprises, in combination, first means to unwind said band at constant linear speed from a reel, second means to, firstly, feed said unwound band at constant linear speed onto a fixed plane support which extends at least from said means into proximity of the cutting system, and secondly, to permit an edge of said band to be applied against a lateral edge guide, and third means to measure the length of band which passes, said third means determining a reference line at right angles to said band and arranged at a predetermined fixed distance from said axis of rotation of said train, this axis of rotation passing through said cutting edge and being at a constant distance from the edge of the band in abutment against the said lateral edge guide.

Thus, in the machine according to the invention, the feed of the band towards the cutting system can be precise, with no slip of the band relative to the support surface, but with accurate lateral guidance. Under these conditions, it is clear that the machine according to the invention is particularly well suited to automated operation.

In an advantageous embodiment, said second means comprise a deformable pressure roller which is applied by its generatrices to the band, and the axis of which is inclined towards said edge guide. It will therefore be realized that such second pressure means impart to the band a feed movement having not only a longitudinal component, but also a transverse component directed towards the edge guide, and that the amplitude of this transverse component can be regulated, particularly as a function of the transverse rigidity of the material of the band, by adjusting the pressure exerted by said pressure roller upon said band.

Preferably, said third means cooperate with said second means and they comprise a cylindrical roller of a rigid substance against which said deformable roller is pressed, and which is associated with a counter. Thus the length of band which passes without slip between the two rollers can be determined precisely from the number of revolutions executed by the rigid roller and from the length of the circular base of the latter.

To permit the reduction in the diameter of the band reel during its unwinding to be taken into account, said first means comprises a friction drive roller for the reel, mounted on a rocker arm, this roller and the deformable roller rotating at the same tangential speed.

In case the cutting tool is, in known manner, a rotary cutter-wheel applied against the cutting edge, whilst the cutting system comprises a carriage movable along a rail, it is advantageous if said cutter-wheel is mounted for rotation and for sliding on a shaft fixed to the carriage and at right angles to said rail but eccentric relative to the latter, if the carriage can rotate at least limitedly about said rail, if the cutter-wheel is provided with a hub adapted to roll on a work holder arranged along the cutting edge, and if elastic means tend to separate mutually the cutter-wheel and the carriage. It is thus possible to press elastically, not only the cutter-wheel against the cutting edge, but also the hub against the work holder, so that the entrainment of the cutter-wheel in rotation can be generated by the simple rolling without slip on the hub of the work holder.

Preferably, downstream of the cutting system, the support surface for the cut pieces consists of two mutually spaced continuous conveyors, and a mobile deflector is provided capable of assuming an inactive position wherein certain cut pieces can pass from one conveyor to the other by straddling the gap between said conveyors, and an active position wherein said deflector compels other pieces to pass into the gap between said conveyors.

It is thus possible, by controlling the deflector, to undertake the sorting and automatic discharge of the cut pieces, in order to separate the usable pieces from the scraps.

The deflector may be mounted on rocker arms and be associated with a pressure roller mounted idly on said rocker arms and cooperating with the upstream conveyor in the active position of the deflector, to increase adhesion of said pieces to said upstream conveyor and therefore facilitate their passage between said conveyors.

BRIEF DESCRIPTION OF THE DRAWINGS

The figures of the accompanying drawing show clearly the preferred embodiment of the invention.

DETAILED DESCRIPTION OF THE INVENTION

Figure 1:
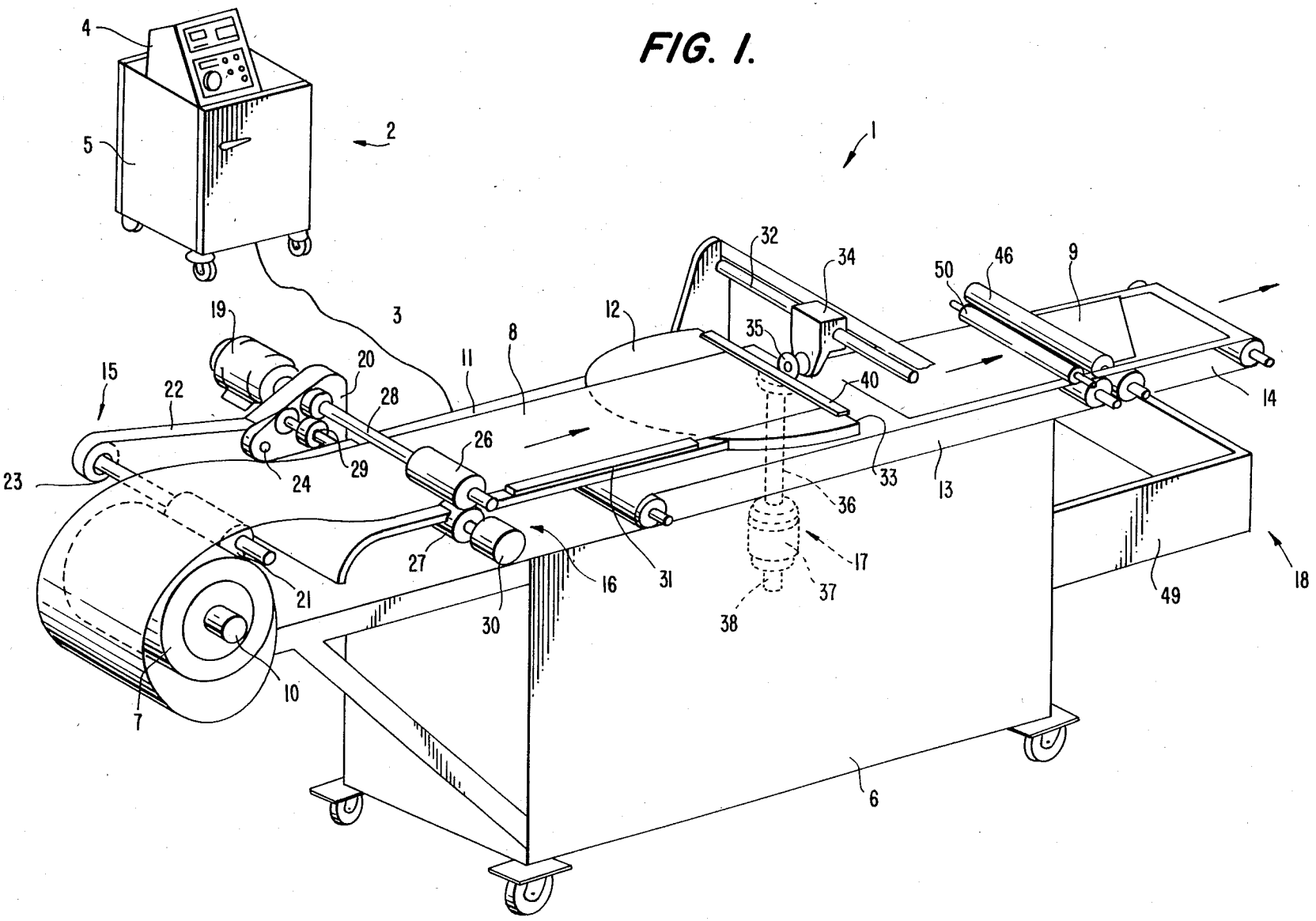
FIG. 1 is a general view in perspective of the machine according to the invention equipped with its control unit.

The machine according to the invention, illustrated in FIG. 1, comprises on the one hand an electromechanical execution assembly 1, and on the other hand a control assembly 2. These two assemblies may be mutually physically separate and connected by connecting cables 3.

The control assembly 2 comprises a numerical control 4 and a control unit 5.

The electromechanical execution assembly 1 is provided with a frame 6 supporting at one of its ends a reel 7 of a band material 8 to be cut into pieces 9, the front end of which may be delimited by right-angle or oblique, straight or broken cutting lines; the rear end of which is delimited by right-angle or oblique cutting lines. The reel 7 is provided with an axis 10 swivelling freely on the frame 6, so as to permit the free unwinding of the band 8.

The top horizontal face of the frame 6 is formed by a fixed table 11, a rotary plate 12 and two endless conveyors 13 and 14. The frame 6 also supports a device 15 for unwinding the band 8 from the reel 7, a device 16 for feeding and guiding the band 8, with which the fixed table 11 is associated, a cutting device 17 to which the rotary plates 12 belong, and a device 18 for sorting and discharging the cut pieces, with which the conveyors 13 and 14 are associated.

In FIG. 1, the frame 6 is shown diagrammatically and incompletely to permit these various elements and devices to be visible.

Figure 2:
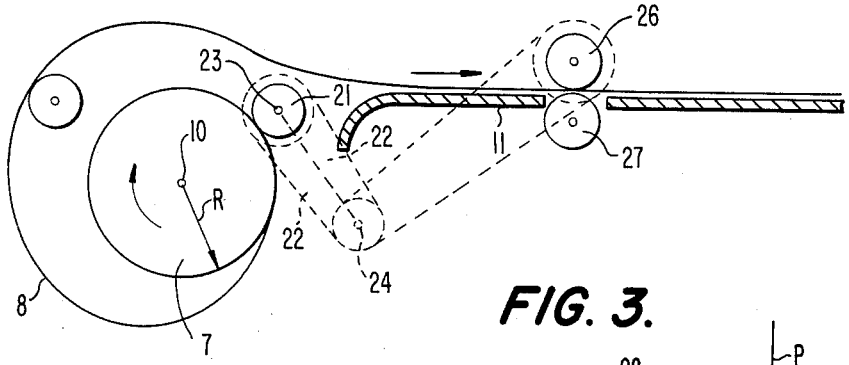
FIG. 2 shows, in diagrammatic side elevation, the device for unwinding the reel formed by the band material to be cut.

The unwinding device 15 (see also FIG. 2) comprises a rubber-lined wheel 21 driving the reel 7 by friction and mounted rotatably at the end of an arm 22 about an axis 23 parallel to the axis 10 of the reel 7. The arm 22 is itself articulated about a fixed axis 24 parallel to the axes 10 and 23, so the rubber-lined wheel 21 is pressed against the reel by the effect of gravity, optionally reinforced by the effect of elastic means, not shown.

The device 16 for feeding and guiding the band 8 (see also FIGS. 3 and 4) comprises a driving wheel 26 driven by a motor 19 associated with a transmission 20, and cooperating with a metallic roller 27. The axes 28 and 29 of the rollers 26 and 27 are located in vertical planes parallel to the axis 10 of the reel 7, and these rollers press between them the band 8, a pressure P being applied to the roller 26 by known means not shown. The roller 27 is housed in an interruption of the table 11, so as to touch substantially the top face of the latter. A coder or counter 30 is also associated with the roller 27 to determine the number of revolutions of said roller and hence the length of the band 8 which passes over the table 11.

An edge guide 31 for the right-hand edge (relative to the direction of feed) of the band 8 is provided along a longitudinal edge of the table 11.

The unwinding roller 21 of the reel 7, by virtue of the transmission 20, is set in rotation by the same motor 19 as that driving in rotation the driving roller 26. The diameters of the two rollers 21 and 26, and the transmission 20 which connects them, are chosen so that the peripheral speeds of these two rollers 21 and 26 are mutually equal and constant. Thus the combination of the articulated arm 22 and of the roller 21 permits the unwinding of the reel to be effected at constant speed, irrespectively of the diameter of this reel, this constant unwinding speed being equal to the feed speed of the band 8 on the fixed table 11. It will be observed that this device also makes it possible, during the operation of the machine according to the invention, to maintain without tension the portion of unwound band 8 arranged between the rollers 21 and 26.

Thus the band feed device 16 does not have to overcome the inertia of the reel 7, but only that of the portion of band located between the roller 21 and the cutting device 17, and that of the rigid roller 27 associated with the sensor 30.

Figure 3:
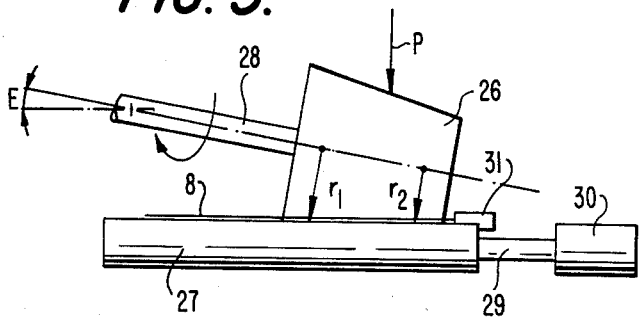
FIGS. 3 and 4 are diagrammatic views, in elevation and in plan respectively, of the device for feeding the band material to be cut.
Figure 4:
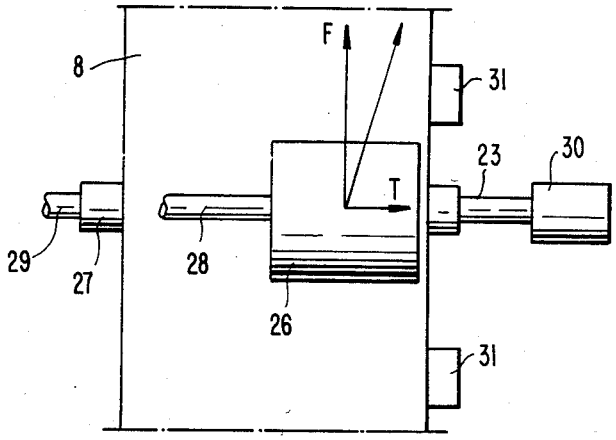

As shown in the diagram, FIG. 3, the driving roller 26 is such that its axis 28, instead of being horizontal, is inclined towards the edge guide by the angle E. Thus, the roller 26 being applied against the band 8, the radius $r_2$ with which it feeds the band 8 on the side of the edge guide 31 is smaller than the radius $r_1$ with which it feeds the band 8 on the side opposite to the edge guide 31. This results in a differential feed speed, so that the edge of the band 8 facing the edge guide 31 is applied constantly against the latter. Indeed, as FIGS. 3 and 4 show, the pressure P applied to the roller 26 generates, due to the obliquity of the latter's axis, a longitudinal force component F effecting the feed of the band 8 and a transverse force component T effecting the application of the edge of said band 8 against the edge guide 31 and hence the lateral reference positioning of the band 8. Consequently, by regulating the pressure P, the amplitude of the force component T can be regulated, which must be sufficient to effect the correct lateral positioning of the band 8, whilst being smaller than the transverse rigidity of the material of the band 8, so as to avoid damaging the latter and therefore incorrectly indicating said positioning.

It will be observed that, due to the presence of the unwinding device 15, the feed force F exerted by the feed device 16 may be weak, so that the pressure P can without disadvantage be regulated so that the amplitude is just sufficient so that a correct lateral positioning of the band 8 is obtained for the transverse force component T.

The driving roller 26 is made of a deformable material. The obliquity of its axis 28 can be obtained by giving said roller either a conical shape or a cylindrical shape, but in the latter case it is necessary to apply the pressure P differentially in order to give the desired obliquity to the axis 28.

The cutting device 17 comprises a transverse horizontal cylindrical rail 32 arranged above the top face 11, 12, 13 and 14 of the frame 6 and fixed to the rotary plate 12. This horizontal rail 32 is parallel to an edge 33 of the rotary plate 12 acting as a cutting edge, and serves to guide a carriage 34 adapted to move in both directions along said rail 32, by the action of a motor or actuating means not shown. The carriage 34 carried a cutting tool 35, for example a cutter-wheel, adapted to follow the cutting edge 33. The train 12, 32, 33, 34, 35 can rotate about a vertical axis 36, for example passing through the longitudinal axis of the band 8 and through the cutting edge 33, by the action of an electric motor 37 associated with a sensor 38 measuring the amplitude of rotation of said train, that is to say the inclination of the cutting edge 33 relative to the direction of passage of the band 8.

Figure 5:
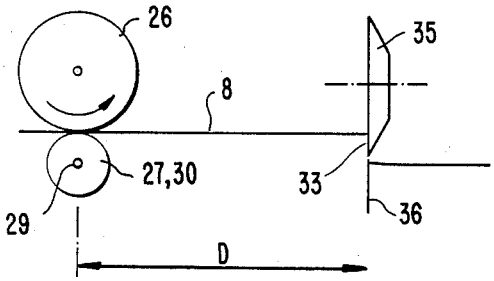
FIG. 5 shows schematically the measuring of the length of the piece to be cut from the band material.

The axis 29 of the rigid roller 27 and of the sensor 30 defines a reference line at right angles to the band 8, serving to measure the feed of the band 8. This reference line 29 is arranged at a known invariable distance D from the axis of rotation 36 of the train 12, 32, 33, 34, 35, this axis 36 being itself located at a constant distance from the edge of the band 8 in abutment against the edge guide 3 (see FIG. 5). It will be observed that, the slip of the band 8 or the roller 27 being negligible, the measurement of the band length 8 by the counter 30 is highly accurate. The measurement of the feed of the band 8 may be counted by the counter 30 as being the length of the band 8 passing in front of the axis of rotation 36, the indication of the sensor 30 being zero at the first cut. To avoid any accumulation of possible length errors, each cutter-wheel pass is treated as a new length reference by the control 2.

It will thus be observed that the following advantageous results are obtained:

the lengths of the cut pieces are independent of the obliquity of the cutting lines, since the latter pass through the axis of rotation 36 of the mobile train 12, 32, 33, 34, 35;

the distance D of the axis 36 of reference 29 takes no part in the measurements;

the distance of the axis 36 from the edge of the band 8 in abutment against the edge guide 31 is a constant of the machine, which advantageously corresponds to half the width of the band 8.

The control 2 awaits a predetermined a value of the counter 30 and actuates the driving roller 26 until this predetermined value is obtained. The rigid roller 27 is driven through the intermediary of the band.

It will therefore be observed that:

the possible slip of the driving roller 26 relative to the band 8 does not affect the precision;

neither the diameter nor the variations in diameter of the driving roller 26 influence the precision.

Figure 6:
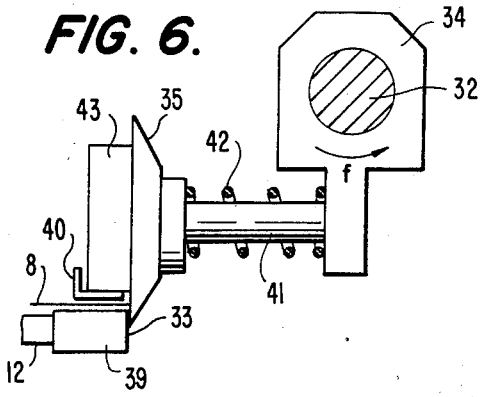
FIG. 6 shows schematically in side elevation, the cutting device of the machine according to the invention.

As FIG. 6 shows, the cutting edge 33 consists of a fixed cutter 39 cooperating with the cutter-wheel 35.

A work holder 40, in the form of an angle piece for example, permits the leading edge of the band 8 to be applied against the top face of the cutter 39. The work holder can be pressed against the band 8 which can be removed from the latter by means not shown.

In an advantageous embodiment, the cutter-wheel 35 is mounted for rotation on a horizontal shaft 41 overhanging relative to the carriage 34 and it can slide along said shaft 41 a spring 42 tending to remove said cutter-wheel from said carriage. A hub 43 is also fixed to the cutter wheel 35 and is adapted to roll on the work holder 40.

It will be observed that such an assembly is particularly advantageous. Indeed, the spring 42 permits simultaneously, the cutter-wheel 35 to be applied against the cutting edge 33 of the cutter 39, and the cylindrical peripheral face of the hub 43 against the work holder 40, since the reaction of the pressure of the cutter-wheel 35 against the cutter 39 tends to swing the carriage 34 about the rail 32, separating it from the cutter 39 (arrow f), that is to say by pressing the hub 43 against the work holder 40. Thus, by virtue of this assembly of the cutter-wheel 35, it is only necessary to move the carriage 34 along the rail 32 in order to rotate said cutter-wheel, since the hub 43 then rolls without slipping upon the work holder 40. It will also be observed that the work holder 40 can be deformed slightly by the pressure of the hub 43, so that it maintains the band 8 correctly in line with the cut.

Figure 7:
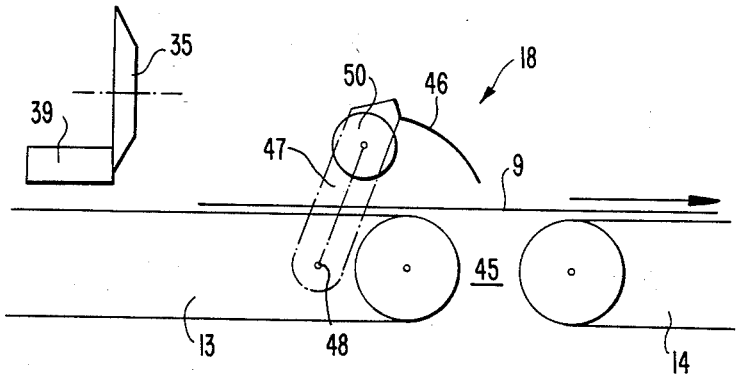
FIGS. 7 and 8 show diagrammatically respectively the position for discharging the useful cuts and the position for discharging the scraps.
Figure 8:
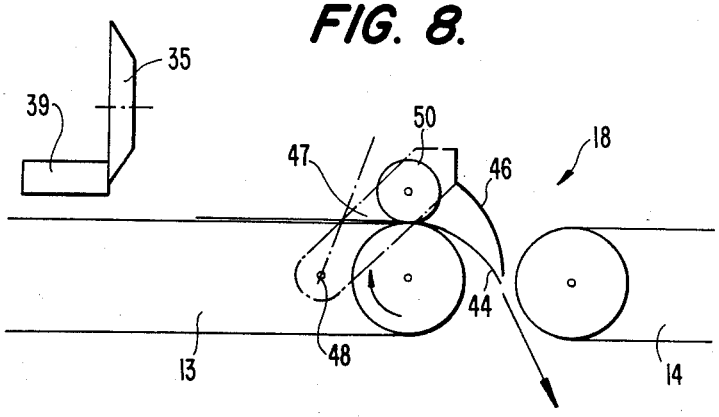

FIGS. 7 and 8 show diagrammatically the device for discharging the cut pieces 9 and the scraps 44 of band material 8, said scraps 44 consisting of useless fragments of the band 8 included between two consecutive pieces 9. As these figures show, the conveyors 13 and 14 are mutually spaced and form an empty gap 49 between them. A deflector 46 mounted at the ends of rocker arms 47 adapted to pivot about a transverse axis 48 by the action of a motor or of an actuating lever (not shown), so that said deflector 46 can occupy either a first position wherein it is located above the empty gap 45 (FIG. 7), or a second position wherein it is located in said empty gap 45 (FIG.8).

In the first position of the deflector 46, the cut pieces 9 can pass beneath the deflector and be transferred from the conveyor 13 to the conveyor 14. In the second position of the deflector 46, the latter presents an obstacle to such a transfer and the scraps 44 of flexible material of the band 8 are directed through the gap 45 into a receiving tank 49. Optionally, an idle pressure roller 50 is provided on the arms 47, which comes to press the scraps 44 against the conveyor 13 in the second position (FIG. 8), so as to increase the adhesion between the conveyor 13 and the scraps 44 and thus favor the discharge of the latter to the tank 49.

The machine according to the invention is suitable for cutting pieces from bands 8 of flexible material, whatever this material may be. However, it has found a particularly worthwhile application in the cutting of pieces of compound material consisting of fibers (glass, carbon, boron, etc.) and of pulverizable resin.

Figure 9:
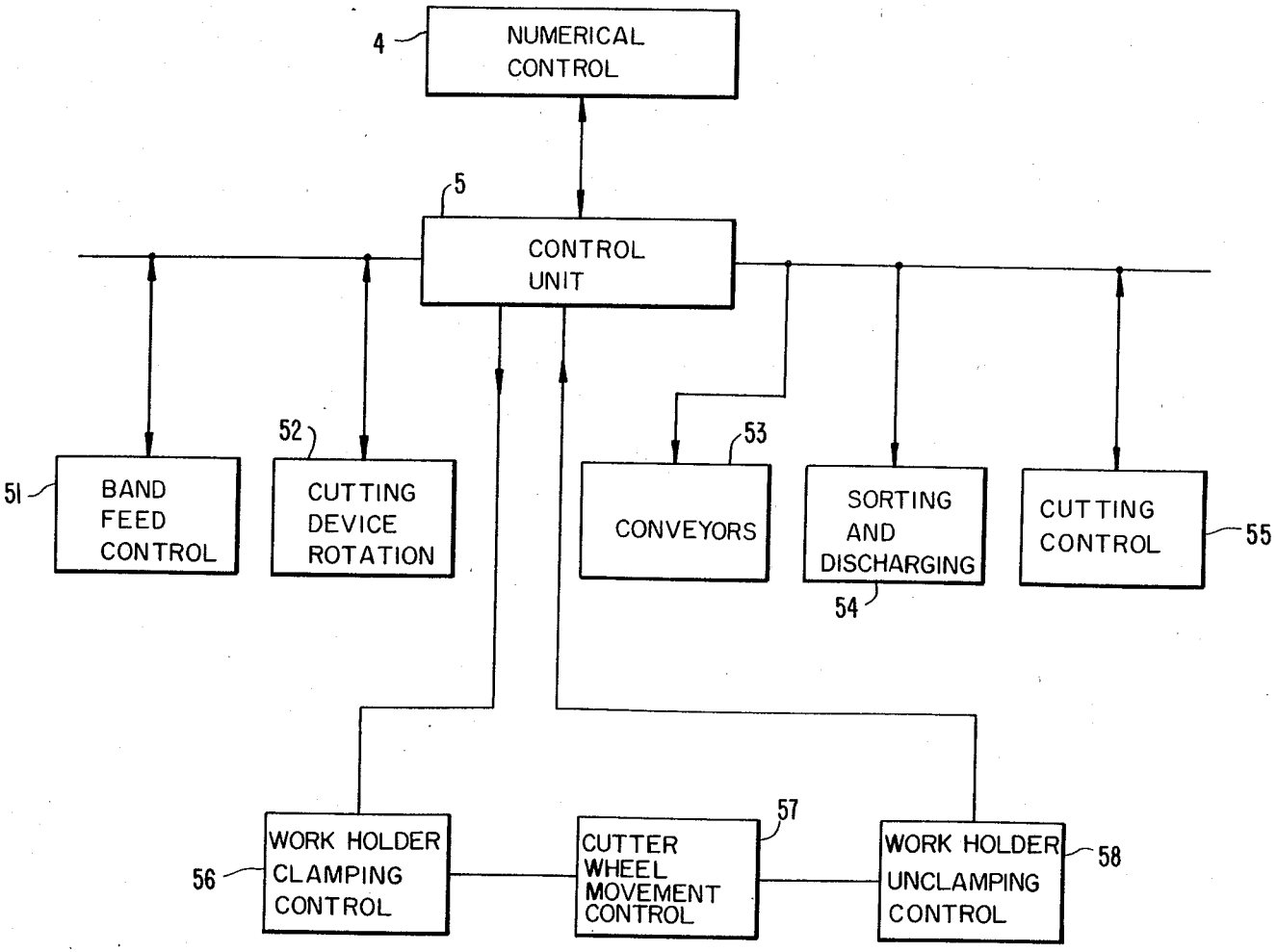
FIG. 9 gives the summary automated operating diagram of the machine according to the invention.

By virtue of its design, the machine lends itself particularly well to fully automated operation, as is illustrated in FIG. 9.

The numerical control 4 issues orders and in turn receives information from the control unit 5. The latter can control at 51 the fed of the band 8 by controlling the devices 15 and 16, at 52 the rotation of the cutting device 17, at 53 the operation of the conveyors 13 and 14, at 54 the device 18 for sorting and discharging the cut pieces and the scraps, and at 55 the cutting of the product by control of an internal cycle of the device 17, which internal cycle comprises, for example, the clamping of the work holder 40 (reference 56), the movement of the cutter-wheel 35 by the carriage 34 (reference 57) and the unclamping of the work holder 40 (reference 58).

Figure 10:
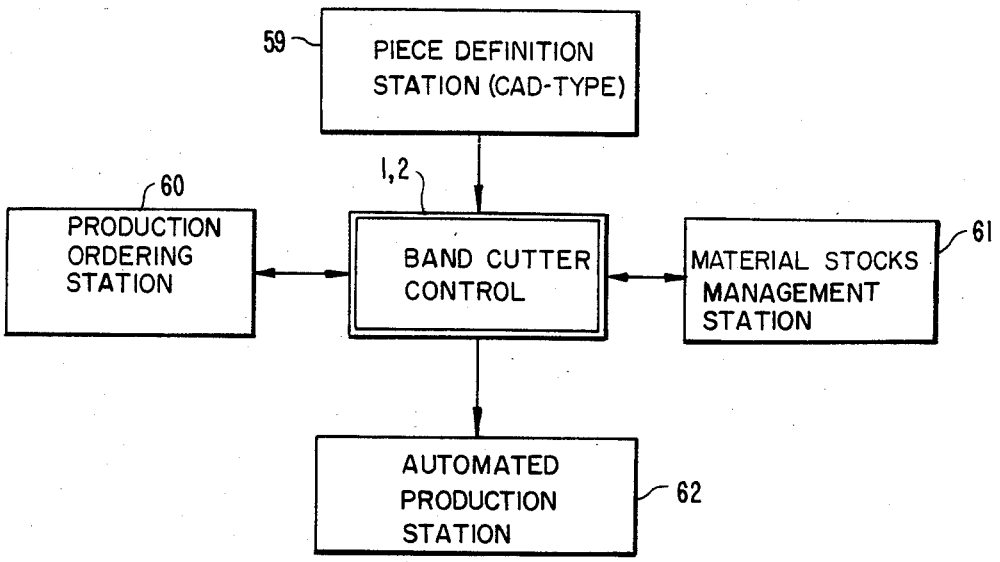
FIG. 10 gives the summary diagram of an automated production process into which the machine according to the invention can be integrated.

Under these conditions, the automated machine according to the invention integrates perfectly into an automated production process of the type illustrated in FIG. 10, which shows that the machine 1, 2 can receive information from a piece definition station 59 of the CAD-type (computer-assisted design) and dialogue with a production ordering station 60 and a material stocks management station 61, to supply the cut pieces 9 to an automated production station 62.

What is claimed is:

1. A machine for cutting at an angle, along a straight, broken, oblique, or right-angled cutting line, a band material adapted to be fed parallel to its length and resting on a substantially planar support surface, comprising in combination: a train mounted for rotation about an axis generally at right angles to said support surface and carrying a cutting system executing a reciprocating movement generally at right angles to said support surface and carrying a cutting system executing a reciprocating movement generally transversely to said band along a cutting edge; a first means for unwinding said band at constant linear speed from a reel; a second means for feeding said unwound band at constant linear speed onto a fixed plane support; said fixed plane support extending at least from said second means into proximity of said cutting system; said second means also permitting an edge of said band to be applied against a lateral edge guide; and a third means for measuring the length of band which passes from said second means to said cutting system, said third means for measuring determining a reference line at right angles to said band and arranged at a predetermined fixed distance D from said axis of rotation of said train, said axis of rotation of said train passing through said cutting edge and being at a constant distance from said edge of the band in abutment against said lateral edge guide; said support surface including two mutually spaced continuous conveyors having a gap therebetween and a mobile deflector, said mobile deflector being selectively capable of assuming an inactive position wherein predetermined cut pieces pass from one of said two continuous conveyors to the other by straddling said gap between said conveyors, and an active position wherein said deflector causes other pieces to pass into the gap between said conveyors; and wherein said deflector is mounted on at least a rocker arm and is associated with a pressure roller mounted on said rocker arms and cooperating with the upstream one of said two continuous conveyors in said active position of said deflector to increase the adhesion of said other pieces to said upstream conveyor and therefore favor passage of said other pieces into said gap between said conveyors; whereby precisely determinable lengths of band can be cut.

2. A machine as claimed in claim 1, said second means further comprising a deformable pressure roller which is applied to the band, said deformable pressure roller having an axis, said axis being inclined relative to said edge guide.

3. A machine as claimed in claim 2, wherein said third means further comprises a rigid roller against which said deformable roller is pressed and which is associated with a counter.

4. A machine according to any one of claims 1 to 3, said first means further comprising a friction drive roller for the reel mounted on a rocker arm, said roller and said deformable pressure roller rotating at a predetermined substantially same tangential speed.

5. A machine according to claim 1, wherein said cutting system comprises a rotary cutter-wheel applied against said cutting edge, said cutting system also comprising a rail and a carriage movable along said rail, said cutter-wheel being mounted for rotation and for sliding on a shaft fixed to said carriage and at generally right angles to said rail but eccentric relative thereto, whereby said carriage can rotate about said rail; said cutter-wheel being provided with a hub adapted to roll on a work holder arranged along said cutting edge, and an elastic means being provided to tend to mutually separate said cutter-wheel and said carriage.

6. A machine according to claim 2, said third means further comprises a rigid roller against which said deformable roller is pressed.

7. A machine according to claim 1, wherein said first means further comprises a friction drive roller for said reel, said friction drive roller being mounted on a rocker arm, said roller and said deformable pressure roller rotating at a same tangential speed as measured at a peripheral surface of said roller and said deformable pressure roller.

8. A machine according to claim 1, wherein said cutting tool is a rotary cutter-wheel applied against said cutting edge, while said cutting system further comprises a carriage movable along a rail, said cutter-wheel being mounted for rotation and for sliding on a shaft fixed to said carriage and generally at right angles to said rail but eccentric to the latter, said carriage being adapted to rotate about said rail, said cutter-wheel having a hub adapted to roll on a work holder arranged along said cutting edge, a resilient means for separating being provided to mutually separate said cutter-wheel and said carriage.

9. A machine according to claim 1, wherein downstream of said cutting system said support surface includes two mutually spaced continuous conveyors and a movable deflector, said movable deflector being capable of assuming an inactive position wherein predetermined cut pieces can pass from one conveyor to the other by straddling the gap between said conveyors, and an active position wherein said deflector compels other pieces to pass into the gap between said conveyors.

10. A machine for cutting at an angle, along a straight, broken, oblique, or right-angled cutting line, a band material adapted to be fed parallel to its length and resting on a substantially planar support surface, comprising in combination: a train mounted for rotation about an axis generally at right angles to said support surface and carrying a cutting system executing a reciprocating movement generally transversely to said band along a cutting edge; a first means for unwinding said band at constant linear speed from a reel; a second means for feeding said unwound band at constant linear speed onto a fixed plane support; said fixed plane support extending at least from said second means into proximity of said cutting system; said second means also permitting an edge of said band to be applied against a lateral edge guide; and a third means for measuring the length of band which passes from said second means to said cutting system, said third means for measuring determining a reference line at right angles to said band and arranged at a predetermined fixed distance D from said axis of rotation of said train, said axis of rotation of said train passing through said cutting edge and being at a constant distance from said edge of the band in abutment against said lateral edge guide; whereby precisely determinable lengths of band can be cut;

a means for controlling formation of pieces from the band material; said second means being controlled by said means for controlling to advance a precisely measured length of band to said cutting edge, said length being measured by said third means for measuring;

said cutting system being controlled by said means for controlling to cut said band material along said cutting edge;

said means for measuring being initialized after each cut, whereby cumulative measuring errors are avoided;

whereby said second means overcomes only the inertia of the band material being held without tension between said first means for unwinding and a free end of said band material projecting beyond said cutting edge, thereby permitting a lighter force to be applied to said band material by said second means than would be required if said first means did not overcome the inertia of said reel; and whereby said band material is evenly moved without damage thereto, by said second means.

* * * * *